US008011501B2

(12) United States Patent
Biondi et al.

(10) Patent No.: US 8,011,501 B2
(45) Date of Patent: Sep. 6, 2011

(54) PACKAGE OF TOBACCO ARTICLES

(75) Inventors: Andrea Biondi, Bologna (IT); Paolo Cremonini, Bologna (IT); Ivanoe Bertuzzi, Casalecchio Di Reno (IT); Roberto Polloni, Modigliana (IT)

(73) Assignee: G.D Societa'per Azioni, Bologna (IT)

( * ) Notice: Subject to any disclaimer, the term of this patent is extended or adjusted under 35 U.S.C. 154(b) by 151 days.

(21) Appl. No.: 12/447,805

(22) PCT Filed: Oct. 30, 2007

(86) PCT No.: PCT/IB2007/003277

§ 371 (c)(1),
(2), (4) Date: Oct. 20, 2009

(87) PCT Pub. No.: WO2008/053320

PCT Pub. Date: May 8, 2008

(65) Prior Publication Data

US 2010/0320101 A1 Dec. 23, 2010

(30) Foreign Application Priority Data

Oct. 31, 2006 (IT) ..... BO2006A0748

(51) Int. Cl.
*B65D 85/10* (2006.01)

(52) U.S. Cl. ..... 206/268; 206/273; 53/461; 53/462; 229/198.2

(58) Field of Classification Search ..... 206/265, 206/268, 271, 273; 229/160.1, 125.08, 126, 229/125.34, 87.14, 198.2; 53/461, 462, 456
See application file for complete search history.

(56) References Cited

U.S. PATENT DOCUMENTS

| | | | | | |
|---|---|---|---|---|---|
| 2,120,258 | A | * | 6/1938 | Arlington | 206/268 |
| 2,429,540 | A | * | 10/1947 | Woodruff | 229/132 |
| 2,906,444 | A | * | 9/1959 | Weiss et al. | 229/228 |
| 2,950,043 | A | * | 8/1960 | Ringler | 206/268 |
| 2,951,626 | A | | 9/1960 | Weiss | |
| 3,079,064 | A | * | 2/1963 | Ringler | 229/160.1 |

(Continued)

FOREIGN PATENT DOCUMENTS

CN 1262662 A 8/2000

(Continued)

OTHER PUBLICATIONS

International Search Report in PCT/IB2007/003277 dated Apr. 16, 2008.

(Continued)

*Primary Examiner* — David T Fidei
(74) *Attorney, Agent, or Firm* — Marshall, Gerstein & Borun LLP

(57) ABSTRACT

A package (1) of tobacco articles, having a group (2) of tobacco articles; a collar (16) surrounding the group (2) of tobacco articles and having a number of lateral walls (17, 18, 19, 20); and an outer package (3) surrounding the group (2) of tobacco articles and the collar (16), and having a top wall (12), a bottom wall (13) parallel to the top wall (12), and a number of lateral walls (8, 9, 10, 11) which are perpendicular to the top and bottom walls (12, 13), and are parallel to and rest on respective lateral walls (17, 18, 19, 20) of the collar (16). A lateral joining wall (8; 10) of the outer package (3) is defined by two panels (8', 8"; 10', 10"), which are separate, coplanar, and side by side with no overlap, and are both glued to an underlying lateral joining wall (17; 19) of the collar (16).

27 Claims, 6 Drawing Sheets

U.S. PATENT DOCUMENTS

| | | | | |
|---|---|---|---|---|
| 5,634,556 | A * | 6/1997 | Focke et al. | 206/268 |
| 5,957,280 | A * | 9/1999 | Focke et al. | 206/264 |
| 6,220,430 | B1 * | 4/2001 | Boriani et al. | 206/268 |
| 6,370,846 | B1 | 4/2002 | Schoch et al. | |
| 6,742,552 | B2 | 6/2004 | Raniwala | |
| 7,934,359 | B2 * | 5/2011 | Ghini et al. | 53/461 |
| 2003/0106928 | A1 | 6/2003 | Angelo | |
| 2007/0108263 | A1 * | 5/2007 | Nash | 229/225 |

FOREIGN PATENT DOCUMENTS

| | | |
|---|---|---|
| DE | 19938196 | 2/2001 |
| DE | 102004023179 | 12/2005 |
| EP | 1712470 | 10/2006 |
| NL | 1028231 | 8/2006 |

OTHER PUBLICATIONS

International Preliminary Report on Patentability in PCT/IB2007/003277 dated Nov. 5, 2008.

Office Action in Chinese Patent Application No. 200780045371.X dated Dec. 19, 2010.

* cited by examiner

PACKAGE OF TOBACCO ARTICLES

CROSS-REFERENCE TO RELATED APPLICATIONS

This is the U.S. national phase of International Application No. PCT/IB2007/003277, filed Oct. 30, 2007, which claims the benefit of Italian Patent Application No. BO2006A000748, filed Oct. 31, 2006.

TECHNICAL FIELD

The present invention relates to a package of tobacco articles.

The present invention may be used to advantage in a rigid, hinged-lid packet of cigarettes, to which the following description refers purely by way of example.

BACKGROUND ART

Rigid, hinged-lid packets of cigarettes are currently the most widely marketed, by being easy to produce, easy and practical to use, and by effectively protecting the cigarettes inside.

A rigid, hinged-lid packet of cigarettes comprises a group of cigarettes wrapped in a sheet of foil; and a rigid outer package housing the group of cigarettes. The outer package comprises a cup-shaped container housing the group of cigarettes and having an open top end; and a cup-shaped lid hinged to the container along a hinge to rotate, with respect to the container, between an open position and a closed position respectively opening and closing the open end. A collar is normally folded and fitted inside the container to project partly outwards of the open end and engage a corresponding inner surface of the lid when the lid is in the closed position.

In a rigid, hinged-lid packet of cigarettes, the outer package is formed by folding a flat blank about the group of cigarettes fitted with the collar, and is stabilized by gluing superimposed tabs of the blank.

At two superimposed tabs, the edge of the outer tab is normally made to coincide with an edge of the outer package to conceal the edge of the outer tab. The above method provides for excellent results in terms of appearance, in the case of square edges, by the edge of the outer tab being superimposed almost perfectly on the square edge, but for only passable results in the case of rounded or bevelled edges, on account of the edge of the outer tab necessarily being located alongside, as opposed to superimposed on, the edge.

DISCLOSURE OF THE INVENTION

It is an object of the present invention to provide a package of tobacco articles, designed to eliminate the aforementioned drawbacks, and which at the same time is cheap and easy to produce.

According to the present invention, there is provided a package of tobacco articles, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
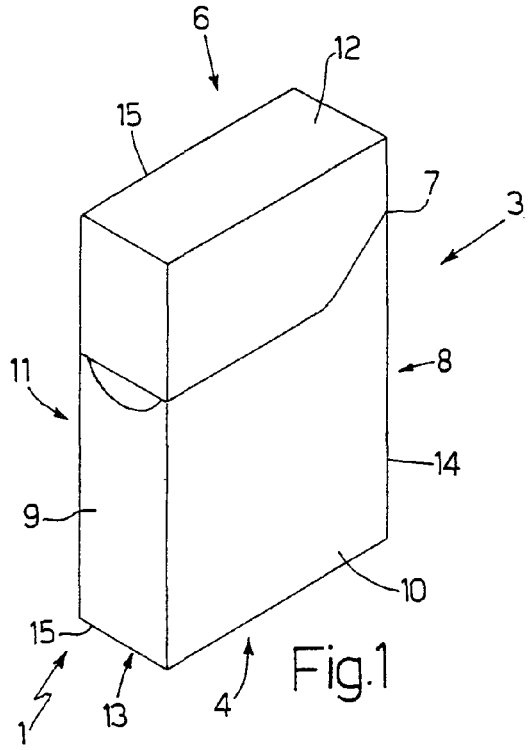
FIG. 1 shows a front view in perspective of a rigid packet of cigarettes in accordance with the present invention and in a closed configuration.
Figure 2:
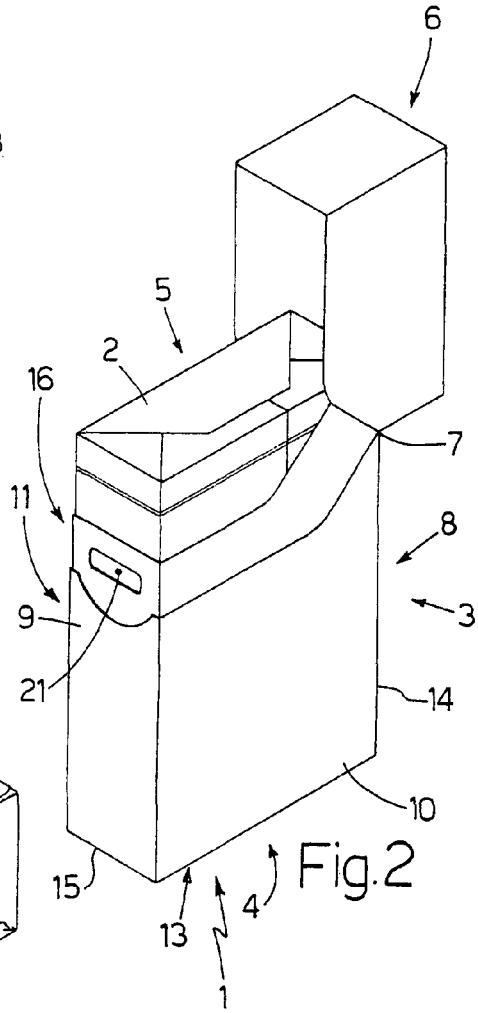
FIG. 2 shows a front view in perspective of the FIG. 1 rigid packet of cigarettes in an open configuration.

In FIGS. 1-4, number 1 indicates as a whole a rigid packet of cigarettes comprising a group 2 of cigarettes wrapped in a sheet of foil; and a rigid outer package 3 housing group 2 of cigarettes. Outer package 3 comprises a cup-shaped container 4 having an open top end 5; and a cup-shaped lid 6 hinged to container 4 along a hinge 7 to rotate, with respect to container 4, between an open position (FIG. 2) and a closed position (FIG. 1) opening and closing open top end 5 respectively.

Lid 6 preferably varies in height, which is minimum at hinge 7, so container 4 is obviously of a height complementary to that of lid 6, and which is therefore maximum at hinge 7.

When lid 6 is in the closed position, outer package 3 is in the form of a rectangular-section parallelepiped, and comprises two parallel opposite minor lateral walls 8, 9; two parallel opposite major lateral walls 10, 11; a top wall 12; and a bottom wall 13 parallel to and opposite top wall 12. Lateral walls 8, 9, 10, 11 are obviously perpendicular to top and bottom walls 12, 13, and minor lateral walls 8, 9 are smaller than major lateral walls 10, 11.

Hinge 7 of lid 6 is located on minor lateral wall 8, which therefore defines a rear wall of outer package 3, whole minor lateral wall 9 defines a front wall of outer package 3.

Outer package 3 has four longitudinal edges 14 defined between lateral walls 8, 9, 10, 11; and eight transverse edges 15 defined between top and bottom walls 12, 13 and lateral walls 8, 9, 10, 11.

Packet 1 of cigarettes also comprises a tubular collar 16, which is folded into a tube about group 2 of cigarettes, is located between group 2 of cigarettes and outer package 3, and projects partly from open top end 5 of container 4 to engage an inner surface of lid 6 when lid 6 is in the closed position.

Figure 4:
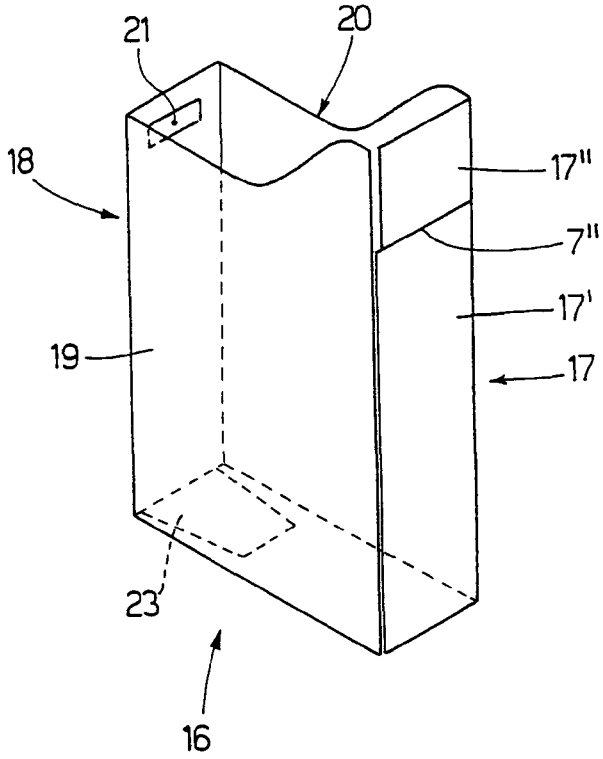
FIG. 4 shows a rear view in perspective of a collar of the FIG. 1 rigid packet of cigarettes.

As shown in FIG. 4, collar 16 comprises a minor lateral wall 17, which is positioned contacting an inner surface of minor lateral wall 8 of outer package 3; a minor lateral wall 18, which is positioned contacting an inner surface of minor lateral wall 9 of outer package 3; a major lateral wall 19, which is positioned contacting an inner surface of major lateral wall 10 of outer package 3; and a major lateral wall 20, which is positioned contacting an inner surface of major lateral wall 11 of outer package 3.

One function of collar 16 is to keep lid 6 in the closed position by making it necessary to apply a certain amount of force to open lid 6. For which purpose, the front wall 18 of collar 16 has a horizontal slit 21; and lid 6 has a tab 22 (shown in FIG. 3), which projects inwards of lid 6 and, when lid 6 is in the closed position, releasably engages slit 21 to retain lid 6 in the closed position.

Figure 3:
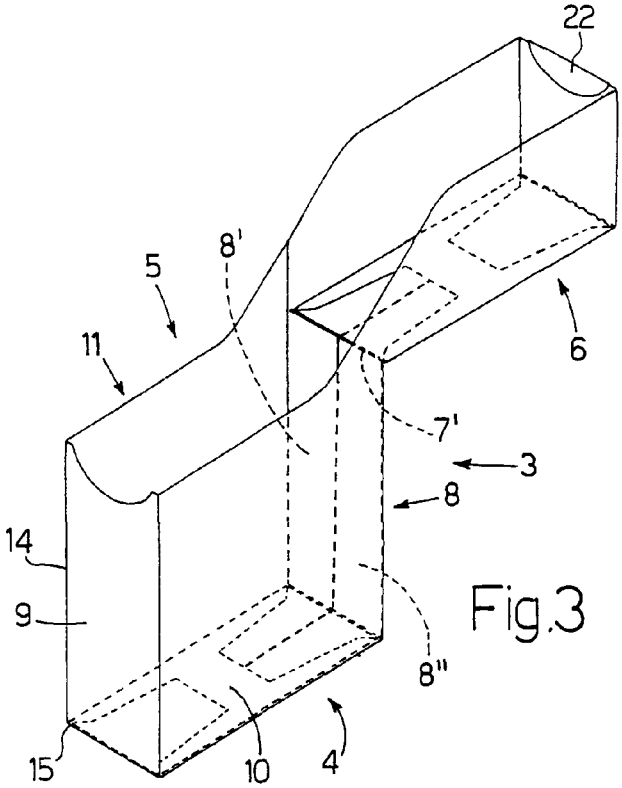
FIG. 3 shows a front view in perspective of an outer package of the FIG. 1 rigid packet of cigarettes in an open configuration.

As shown in FIGS. 3 and 4, minor lateral wall 8 of outer package 3 constitutes a joining wall of outer package 3; and minor lateral wall 17 of collar 16 constitutes a joining wall of collar 16. More specifically, minor lateral wall 8 of outer package 3 (i.e. the lateral joining wall 8 of outer package 3) comprises two separate, coplanar panels 8' and 8" (shown more clearly in FIG. 5), which are located side by side with no overlap, and are both glued to the underlying minor lateral wall 17 of collar 16 (i.e. the underlying lateral joining wall 17 of collar 16).

Hinge 7 is defined by a fold line 7' formed on minor lateral wall 8 of outer package 3 (i.e. on the lateral joining wall 8 of outer package 3), and by a fold line 7" formed on minor lateral wall 17 of collar 16 (i.e. on the lateral joining wall 17 of collar 16) and underlying fold line 7'.

Fold line 7" divides minor lateral wall 17 of collar 16 (i.e. the lateral joining wall 17 of collar 16) into a bottom portion 17', which is integral with container 4 of outer package 3 and connected to the adjacent major lateral wall 19 of collar 16; and into a top portion 17", which is integral with lid 6 of outer package 3 and separated from the adjacent major lateral wall 19 of collar 16, so as to move freely with respect to adjacent major lateral wall 19. It is important to note that top portion 17" of minor lateral wall 17 of collar 16 must be separated from adjacent major lateral wall 19 to allow lid 6 to rotate about hinge 7 (i.e. top portion 17" to rotate about fold line 7").

In a preferred embodiment, to improve the stability of packet 1 of cigarettes, collar 16 has at least one bottom tab 23 positioned contacting bottom wall 13 of outer package 3 (i.e. located between a bottom wall of group 2 of cigarettes and bottom wall 13 of outer package 3), and which may be glued to bottom wall 13.

Figure 5:
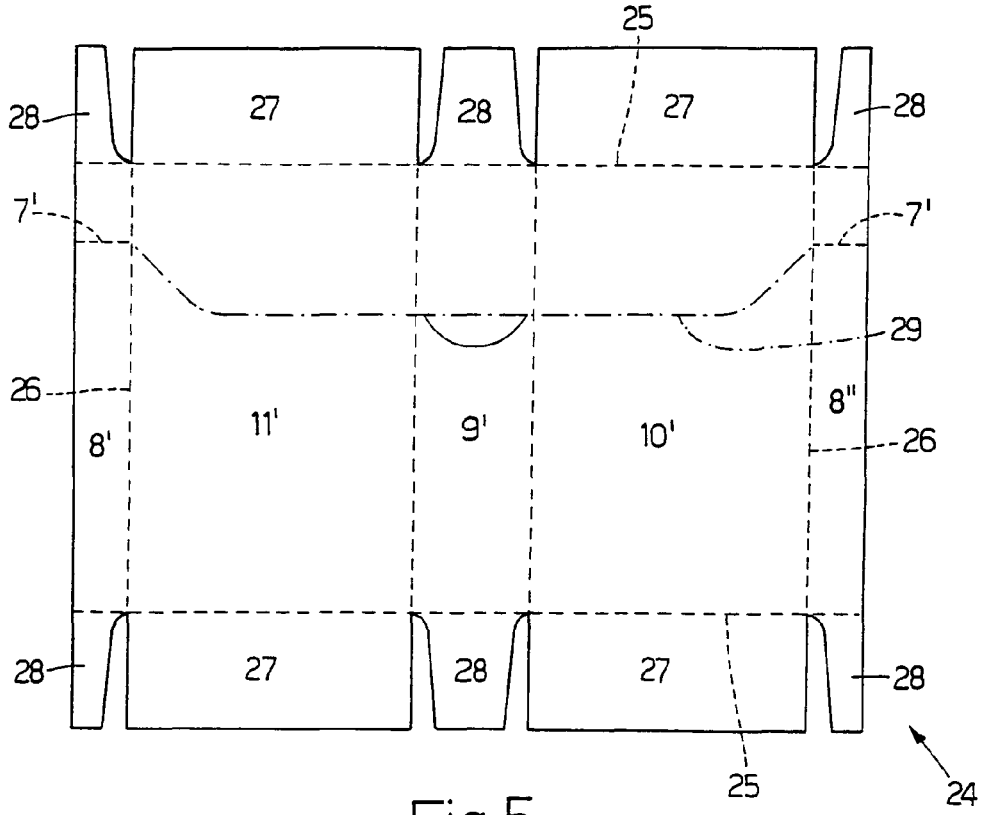
FIG. 5 shows a spread-out plan view of a blank by which to form an outer package of the rigid packet of cigarettes in FIGS. 1-4.
Figure 6:
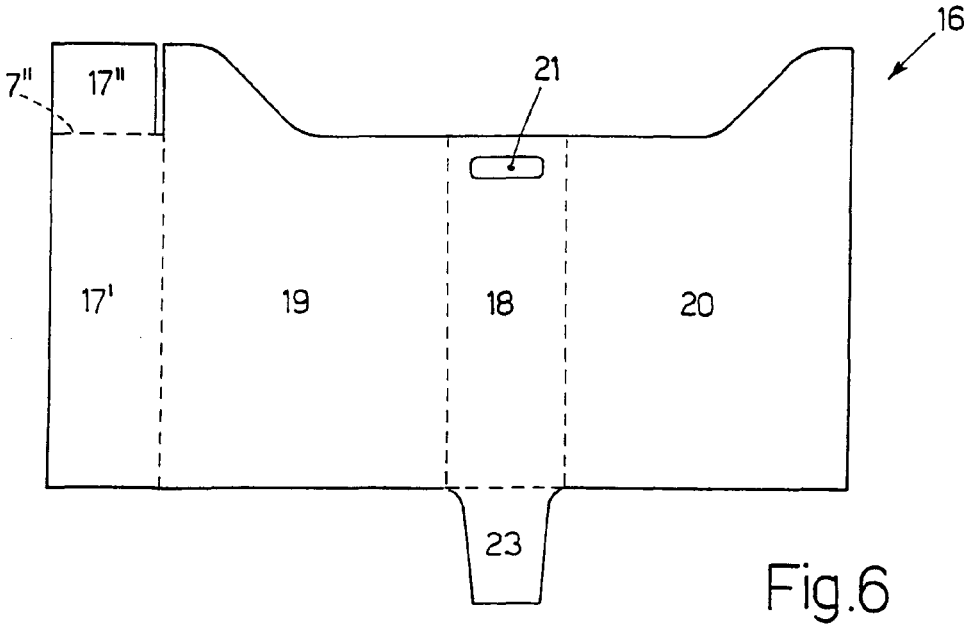
FIG. 6 shows a spread-out plan view of a collar of the rigid packet of cigarettes in FIGS. 1-4.

Outer package 3 of rigid packet 1 of cigarettes is formed by folding a blank 24 shown flat in FIG. 5, in which the parts of blank 24 are indicated, where possible, using the same reference numbers, with superscripts, as for the corresponding parts of outer package 3.

Blank 24 comprises two transverse fold lines 25, and a number of longitudinal fold lines 26 defining, between the two transverse fold lines 25: panel 8' forming part of minor lateral joining wall 8; a panel 11' defining major lateral wall 11; a panel 9' defining minor lateral wall 9; a panel 10' defining major lateral wall 10; and panel 8" forming the remaining part of minor lateral joining wall 8.

Panels 10' and 11' each comprise two major tabs 27, which are located at opposite ends of panel 10', 11', are separated from panel 10', 11' by the two transverse fold lines 25, and form part of top wall 12 and bottom wall 13 respectively.

Panels 8', 9' and 8" each comprise two minor tabs 28, which are located at opposite ends of panel 8', 9', 8", are separated from panel 8', 9', 8" by the two transverse fold lines 25, and form part of top wall 12 and bottom wall 13 respectively.

Blank 24 also comprises a substantially transverse tear line 29 separating container 4 and lid 6. In other words, lid 6 is initially joined to container 4 along tear line 29, and is detached from container 4 by the user tearing along tear line 29 when unsealing packet 1 of cigarettes.

To produce packet 1 of cigarettes, collar 16 is applied to and folded about group 2 of cigarettes; and blank 24 is then applied to and folded about group 2 of cigarettes, on top of collar 16. When folding blank 24, minor lateral joining wall 8 is formed last, by placing panels 8' and 8" on top of minor lateral joining wall 17 of collar 16 and group 2 of cigarettes, so that panels 8' and 8" are coplanar and side by side with no overlap, and by simultaneously gluing panels 8' and 8" of minor lateral joining wall 8 of outer package 3 to the underlying minor lateral joining wall 17 of collar 16.

Figure 7:
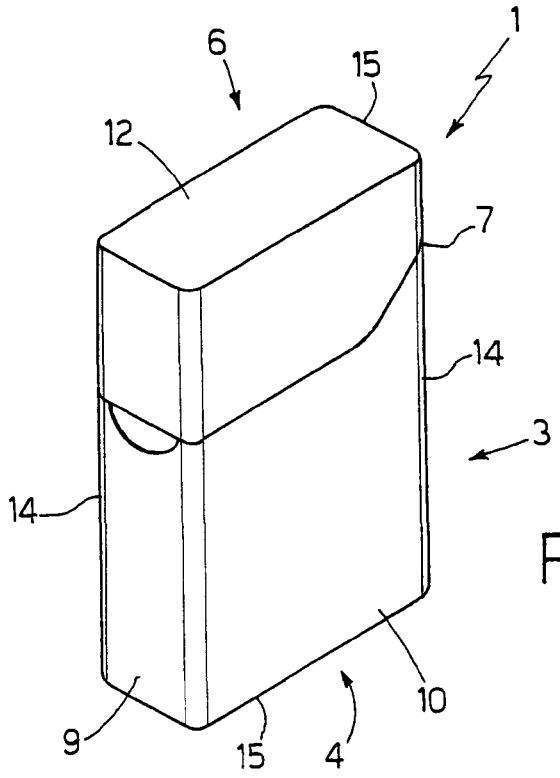
FIG. 7 shows a front view in perspective of a variation of the rigid packet of cigarettes in FIGS. 1-4.

In the FIG. 1-4 embodiment, longitudinal edges 14 and transverse edges 15 are all square. In the FIG. 7 variation, longitudinal edges 14 are rounded; in which case, to form rounded edges 14, blank 24 must comprise four groups of closely spaced longitudinal fold lines to allow blank 24 to flex locally into a circular shape. In different embodiments not shown, at least some of longitudinal edges 14 are rounded or bevelled, or at least some of transverse edges 15 are rounded or bevelled (as in the packet of cigarettes described in Patent Application EP-A1-0764595). Alternatively, some longitudinal edges 14 and some transverse edges 15 may be non-square, rounded or bevelled edges, so as to have both non-square, rounded or bevelled longitudinal edges 14 and transverse edges 15.

In a different embodiment not shown, packet 1 of cigarettes may resemble the packet of cigarettes described in Patent Application EP-A1-1066206; in which case, major lateral walls 10 and 11 are outwardly convex, and each have a flat central portion, and two curved creased lateral bands connecting the flat central portion to minor lateral walls 8 and 9 at respective sharp, non-square longitudinal edges 14. Changes may obviously made to packets 1 of cigarettes resembling the packet of cigarettes described in Patent Application EP-A1-1066206, such as partly curving the convex walls, or only curving one wall as opposed to two opposite walls, or curving minor lateral walls 8 and 9 as opposed to major lateral walls 10 and 11. By way of example, a few variations of the packet of cigarettes described in Patent Application EP-A1-1066206 are proposed in Patent Application WO03026984A1.

Figure 8:
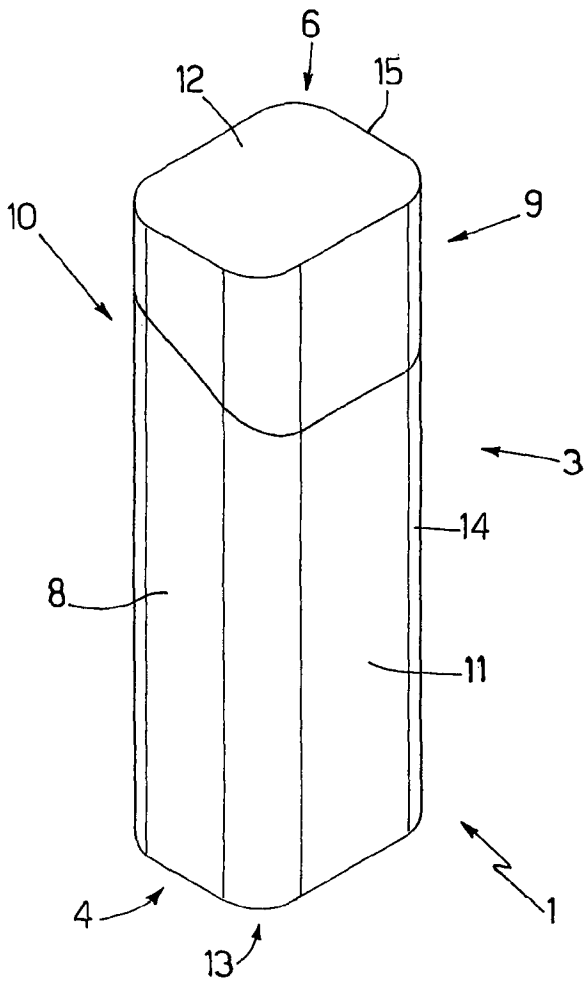
FIG. 8 shows a front view in perspective of a different embodiment of a rigid packet of cigarettes in accordance with the present invention and in a closed configuration.

FIG. 8 shows a different embodiment of a rigid packet 1 of cigarettes, which differs from that in FIGS. 1-6 as regards the cross section of outer package 3, and hence the shape of group 2 of cigarettes, and by longitudinal edges 14 being rounded as opposed to square.

The rigid packet 1 of cigarettes in FIG. 8 also differs from that in FIGS. 1-6 by hinge 7 being located on major lateral wall 10 as opposed to minor lateral wall 8. Consequently, in the FIG. 8 rigid packet 1 of cigarettes, major lateral wall 10 constitutes a rear wall of outer package 3, and major lateral wall 11 constitutes a front wall of outer package 3.

Collar 16 of the FIG. 8 rigid packet 1 of cigarettes has two rectangular bottom tabs 23, as opposed to one trapezoidal tab 23 as in collar 16 of rigid packet 1 of cigarettes in FIGS. 1-6.

Finally, the FIG. 8 rigid packet 1 of cigarettes differs from that in FIGS. 1-6 by the joining wall of outer package 3 being major lateral wall 10 as opposed to minor lateral wall 8. Consequently, major lateral wall 10 of the FIG. 8 rigid packet 1 of cigarettes comprises two separate, coplanar panels 10' and 10", which are located side by side with no overlap, and are both glued to the underlying major lateral wall 19 of collar 16 (i.e. the underlying lateral joining wall 19 of collar 16).

Figure 9:
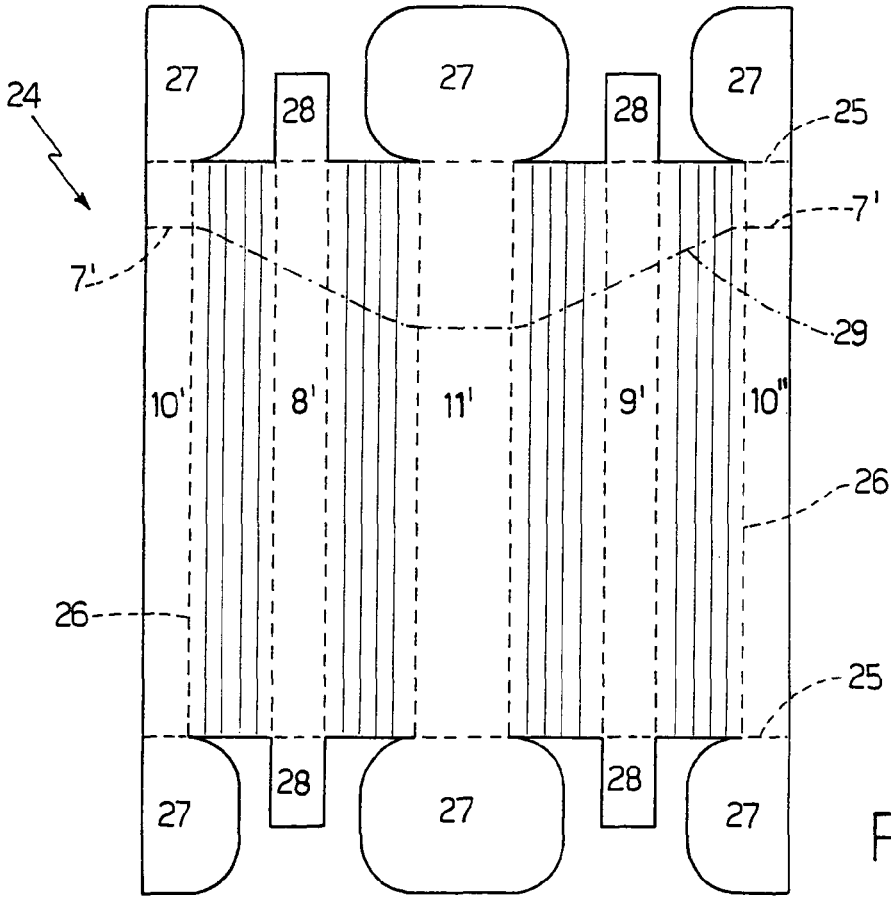
FIG. 9 shows a spread-out plan view of a blank by which to form an outer package of the rigid packet of cigarettes in FIG. 8.
Figure 13:
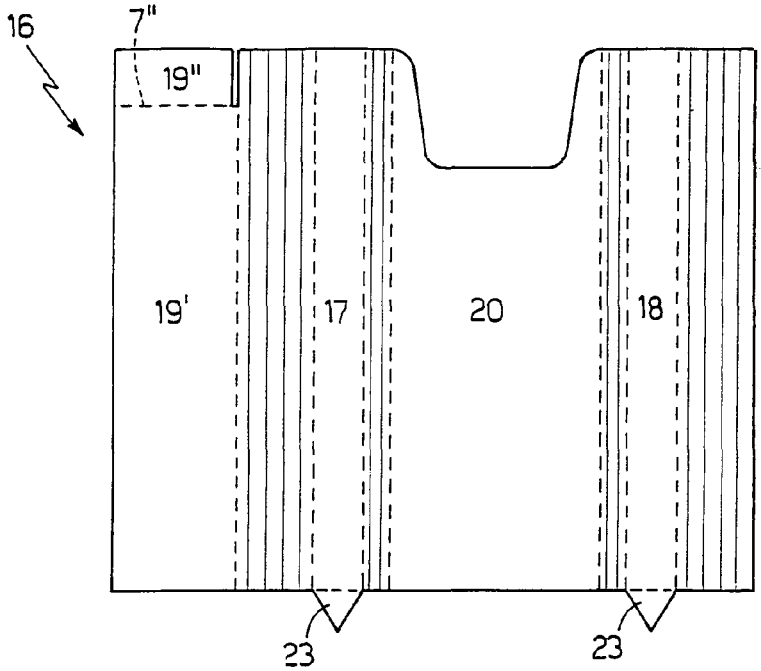
FIG. 13 shows a spread-out plan view of a collar of the rigid packet of cigarettes in FIG. 11.
Figure 12:
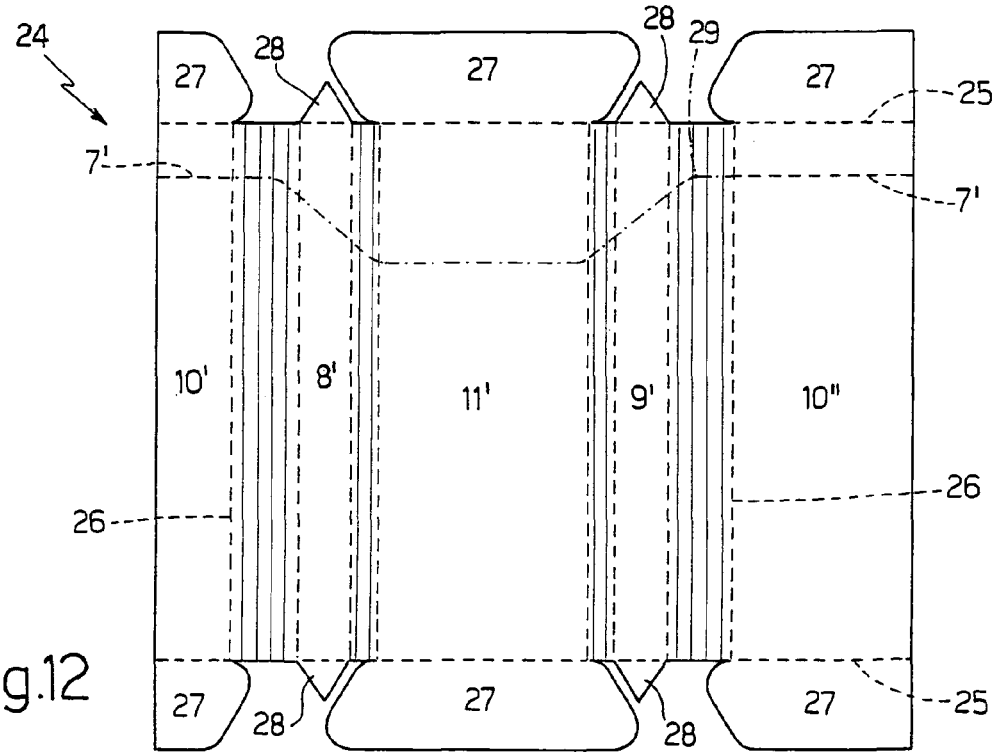
FIG. 12 shows a spread-out plan view of a blank by which to form an outer package of the rigid packet of cigarettes in FIG. 11.

Outer package 3 of the FIG. 8 rigid packet 1 of cigarettes is formed by folding a blank 24 shown flat in FIG. 9, in which the parts of blank 24 are indicated, where possible, using the same reference numbers, with superscripts, as for the corresponding parts of outer package 3.

Blank 24 comprises two transverse fold lines 25, and a number of longitudinal fold lines 26 defining, between the two transverse fold lines 25: panel 10' forming part of major lateral joining wall 10; a panel 8' defining minor lateral wall 8; a panel 11' defining major lateral wall 11; a panel 9' defining minor lateral wall 9; and panel 10" forming the remaining part of major lateral joining wall 10.

Panels 10', 11' and 10" each comprise two major tabs 27, which are located at opposite ends of panel 10', 11', 10", are separated from panel 10', 11', 10" by the two transverse fold lines 25, and form part of top wall 12 and bottom wall 13 respectively.

Panels 8' and 9' each comprise two rectangular minor tabs 28, which are located at opposite ends of panel 8', 9', are separated from panel 8', 9' by the two transverse fold lines 25, and form part of top wall 12 and bottom wall 13 respectively.

Blank 24 also comprises a substantially transverse tear line 29 separating container 4 and lid 6.

It is important to note that, to form rounded edges 14, blank 24 comprises four groups of closely spaced longitudinal fold lines to allow blank 24 to flex locally into a circular shape.

To produce packet 1 of cigarettes, collar 16 is applied to and folded about group 2 of cigarettes; and blank 24 is then applied to and folded about group 2 of cigarettes, on top of collar 16. When folding blank 24, major lateral joining wall 10 is formed last, by placing panels 10' and 10" on top of major lateral joining wall of collar 16 and group 2 of cigarettes, so that panels 10' and 10" are coplanar and side by side with no overlap, and by simultaneously gluing panels 10' and 10" of major lateral joining wall 10 of outer package 3 to the underlying major lateral joining wall 19 of collar 16.

Figure 11:
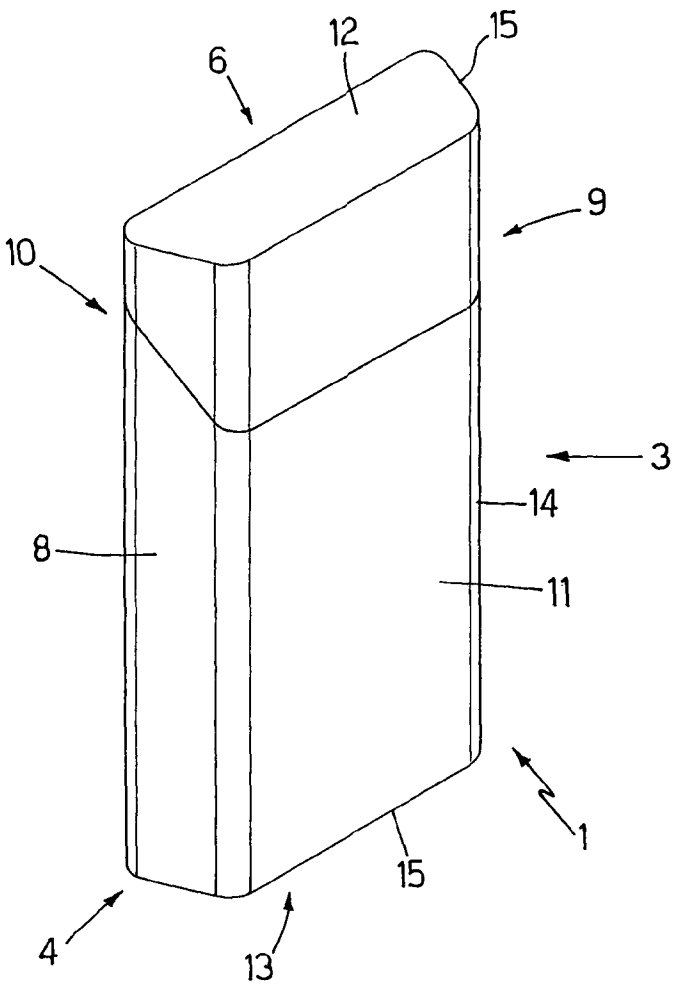
FIG. 11 shows a front view in perspective of a further embodiment of a rigid packet of cigarettes in accordance with the present invention and in a closed configuration.
Figure 10:
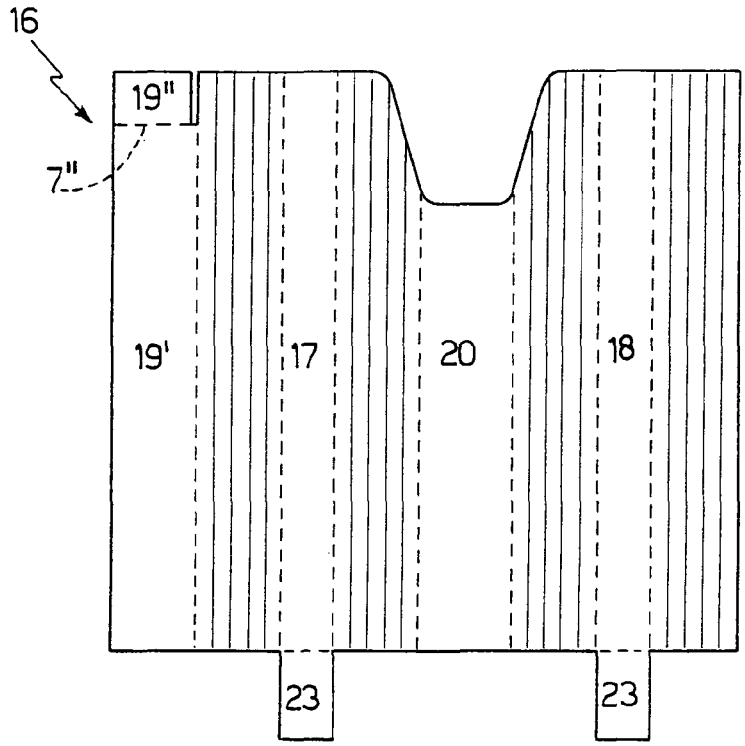
FIG. 10 shows a spread-out plan view of a collar of the rigid packet of cigarettes in FIG. 8.

FIG. 11 shows a further embodiment of a rigid packet 1 of cigarettes, which differs from that in FIG. 8 as regards the cross section of outer package 3, and hence the shape of group 2 of cigarettes.

The collar 16 and blank 24 of the FIG. 11 packet 1 of cigarettes are very similar to those of the FIG. 8 packet 1 of cigarettes, to the above description of which the reader is therefore referred. It is important to note that bottom tabs 23 of collar 16, and minor tabs 28 of blank 24 of the FIG. 11 packet 1 of cigarettes are triangular.

In a further embodiment not shown, rigid packet 1 of cigarettes may comprise an outer package 3 with a triangular (equilateral triangular) cross section, and preferably rounded longitudinal edges 14; in which case, outer package 3 has three lateral walls (all the same size).

Packet 1 of cigarettes as described above has numerous advantages it is cheap and easy to produce, and is of excellent appearance, even in the case of non-square edges, by virtue of outer package 3 having no visible overlaps.

Given its numerous advantages, the design of packet 1 of cigarettes as described above may also be applied integrally to the manufacture of a carton of packets of cigarettes (both rigid and soft), which is substantially the same as packet 1 described above, except that it contains packets, as opposed to a group, of cigarettes.

The invention claimed is:

1. A package of tobacco articles, comprising:

a group (2) of tobacco articles;

a collar (16) surrounding the group (2) of tobacco articles and having a number of lateral walls (17, 18, 19, 20); and an outer package (3) surrounding the group (2) of tobacco articles and the collar (16), and having a top wall (12); a bottom wall (13) parallel to the top wall (12); and a number of lateral walls (8, 9, 10, 11) which are perpendicular to the top and bottom walls (12, 13), and are parallel to and rest on respective lateral walls (17, 18, 19, 20) of the collar (16);

the package (1) being characterized in that a lateral joining wall (8; 10) of the outer package (3) is defined by two panels (8', 8"; 10', 10"), which are separate, coplanar, and side by side with no overlap, and are both glued to an underlying lateral joining wall (17; 19) of the collar (16).

2. A package of tobacco articles as claimed in claim 1, wherein the collar (16) is tubular.

3. A package of tobacco articles as claimed in claim 1, wherein the collar (16) has at least one bottom tab (23) contacting the bottom wall (13) of the outer package (3).

4. A package of tobacco articles as claimed in claim 3, wherein the bottom tab (23) of the collar (16) is glued to the bottom wall (13) of the outer package (3).

5. A package of tobacco articles as claimed in claim 1, wherein the outer package (3) comprises a cup-shaped container (4) having an open top end (5); and a cup-shaped lid (6) hinged to the container (4) along a hinge (7) to rotate, with respect to the container (4), between an open position and a closed position opening and closing the open top end (5) respectively.

6. A package of tobacco articles as claimed in claim 5, wherein the hinge (7) is located on the lateral joining wall (8; 10) of the outer package (3).

7. A package of tobacco articles as claimed in claim 6, wherein the hinge (7) is defined by a first fold line (7') formed on the lateral joining wall (8; 10) of the outer package (3), and by a second fold line (7") formed on the lateral joining wall (17; 19) of the collar (16) and underlying the first fold line (7').

8. A package of tobacco articles as claimed in claim 6, wherein the second fold line (7") divides the lateral joining wall (17; 19) of the collar (16) into a bottom portion (17'; 19') integral with the container (4) of the outer package (3) and connected to an adjacent lateral wall (19; 17) of the collar (16), and into a top portion (17";

19") integral with the lid (6) of the outer package (3) and separated from the adjacent lateral wall (19; 17) of the collar (16).

9. A package of tobacco articles as claimed in claim 6, wherein the outer package (3) has a rectangular cross section, and comprises two parallel opposite major lateral walls (10, 11), and two parallel opposite minor lateral walls (8, 9).

10. A package of tobacco articles as claimed in claim 9, wherein the lateral joining wall (8) of the outer package (3), in which the hinge (7) is formed, is a minor lateral wall (8).

11. A package of tobacco articles as claimed in claim 10, wherein the outer package (3) is formed by folding about the group (2) of cigarettes and about the collar (16) a flat blank (24), which has two transverse fold lines (25), and a number of longitudinal fold lines (26) defining, between the two transverse fold lines (25), a first panel (8') forming part of the joining minor lateral wall (8); a second panel (11') forming one major lateral wall (11); a third panel (9') forming the other minor lateral wall (9); a fourth panel (10') forming the other major lateral wall (10); and a fifth panel (8") forming the remaining part of the joining minor lateral wall (8).

12. A package of tobacco articles as claimed in claim 11, wherein the second and fourth panel (11', 10') each have two major tabs (27), which are located at opposite ends of the second or fourth panel (11', 10'), are separated from the second or fourth panel (11', 10') by the two transverse fold lines (25), and form part of the top and bottom walls (12, 13) respectively.

13. A package of tobacco articles as claimed in claim 11, wherein the first, third, and fifth panel (8', 9', 8") each have two minor tabs (28), which are located at opposite ends of the first, third, or fifth panel (8', 9', 8"), are separated from the first, third, or fifth panel (8', 9', 8") by the two transverse fold lines (25), and form part of the top and bottom walls (12, 13) respectively.

14. A package of tobacco articles as claimed in claim 11, wherein the blank (24) has a substantially transverse tear line (29) separating the container (4) and the lid (6).

15. A package of tobacco articles as claimed in claim 9, wherein the lateral joining wall (10) of the outer package (3), in which the hinge (7) is formed, is a major lateral wall (10).

16. A package of tobacco articles as claimed in claim 15, wherein the outer package (3) is formed by folding about the group (2) of cigarettes and about the collar (16) a flat blank (24), which has two transverse fold lines (25), and a number of longitudinal fold lines (26) defining, between the two transverse fold lines (25), a first panel (10') forming part of the joining major lateral wall (10); a second panel (8') forming one minor lateral wall (8); a third panel (11') forming the other major lateral wall (11); a fourth panel (9') forming the other minor lateral wall (9); and a fifth panel (10") forming the remaining part of the joining major lateral wall (10).

17. A package of tobacco articles as claimed in claim 16, wherein the first, third and fifth panel (10', 11', 10") each have two major tabs (27), which are located at opposite ends of the first, third, or fifth panel (10', 11', 10"), are separated from the first, third, or fifth panel (10', 11', 10") by the two transverse fold lines (25), and form part of the top and bottom walls (12, 13) respectively.

18. A package of tobacco articles as claimed in claim 16, wherein the second and fourth panel (8', 9') each have two minor tabs (28), which are located at opposite ends of the second or fourth panel (8', 9'), are separated from the second or fourth panel (8', 9') by the two transverse fold lines (25), and lot in part of the top and bottom walls (12, 13) respectively.

19. A package of tobacco articles as claimed in claim 18, wherein the minor tabs (28) are triangular.

20. A package of tobacco articles as claimed in claim 18, wherein the minor tabs (28) are rectangular.

21. A package of tobacco articles as claimed in claim 16, wherein the blank (24) has a substantially transverse tear line (29) separating the container (4) and the lid (6).

22. A package of tobacco articles as claimed in claim 6, wherein the outer package (3) has an equilateral triangular cross section, and three lateral walls.

23. A package of tobacco articles as claimed in any claim 1, wherein the outer package (3) has a number of longitudinal edges (14) defined between the lateral walls (8, 9, 10, 11).

24. A package of tobacco articles as claimed in claim 23, wherein the longitudinal edges (14) are square.

25. A package of tobacco articles as claimed in claim 23, wherein the longitudinal edges (14) are rounded.

26. A package of tobacco articles as claimed in claim 23, wherein the longitudinal edges (14) are bevelled.

27. A method of folding a blank (24) to produce a package (1) of tobacco articles comprising:

a group (2) of tobacco articles;

a collar (16) surrounding the group (2) of tobacco articles and having a number of lateral walls (17, 18, 19, 20); and an outer package (3) surrounding the group (2) of tobacco articles and the collar (16), and having a top wall (12); a bottom wall (13) parallel to the top wall (12); and a number of lateral walls (8, 9, 10, 11) which are perpendicular to the top and bottom walls (12, 13), and are parallel to and rest on respective lateral walls (17, 18, 19, 20) of the collar (16);

the method being characterized by comprising the steps of:

placing, to form a lateral joining wall (8; 10) of the outer package (3), two separate panels (8', 8"; 10', 10") of the blank (24) on top of a lateral joining wall (17; 19) of the collar (16) and on top of the group (2) of cigarettes, so that the two panels (8', 8"; 10', 10") are coplanar and side by side with no overlap; and gluing the two panels (8', 8"; 10', 10") of the lateral joining wall (8; 10) of the outer package (3) to the underlying lateral joining wall (17; 19) of the collar (16).

* * * * *